US006777883B2

(12) United States Patent
Mukherjee

(10) Patent No.: US 6,777,883 B2
(45) Date of Patent: Aug. 17, 2004

(54) INTEGRATED LED DRIVE ELECTRONICS ON SILICON-ON-INSULATOR INTEGRATED CIRCUITS

(75) Inventor: Satyen Mukherjee, Yorktown Heights, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/119,547

(22) Filed: Apr. 10, 2002

(65) Prior Publication Data

US 2003/0193300 A1 Oct. 16, 2003

(51) Int. Cl.[7] ..... H01J 40/14
(52) U.S. Cl. ..... 315/149; 358/417; 315/291
(58) Field of Search ..... 315/291, 307, 315/308, 149–159, 241 S, 241 P; 362/11, 33, 216, 297, 346; 358/297, 346, 475, 482, 497; 250/208.1

(56) References Cited

U.S. PATENT DOCUMENTS 4,316,074 A * 2/1982 Daly ..... 219/121 L
4,543,133 A * 9/1985 Mukai ..... 148/1.5
4,598,198 A * 7/1986 Fayfield ..... 250/205
4,809,056 A * 2/1989 Shirato et al. ..... 357/71
6,238,060 B1 * 5/2001 Bourn et al. ..... 362/216
6,344,641 B1 * 2/2002 Blalock et al. ..... 250/205
6,356,365 B1 * 3/2002 Oida et al. ..... 315/307

OTHER PUBLICATIONS

Sybil P. Parker, McGraw–Hill Dictionary of Scientific and Technical Terms 5$^{th}$ edition, 1994, p. 1826.*

* cited by examiner

*Primary Examiner*—Wilson Lee
(74) *Attorney, Agent, or Firm*—Peter Zawilski

(57) ABSTRACT

An integrated circuit for controlling an array of LEDs includes at least one signal amplifier, signal processing means, driver means for driving the array of light emitting diodes, at least one switch, and control means for controlling the integrated circuit. The integrated circuit is formed using silicon-on-insulator technology and is selectively shielded from the array of LEDs. The integrated drive electronics with silicon-on-insulator technology will allow for improved white light generation.

15 Claims, 4 Drawing Sheets

INTEGRATED LED DRIVE ELECTRONICS ON SILICON-ON-INSULATOR INTEGRATED CIRCUITS

BACKGROUND OF THE INVENTION

The invention relates to a luminaire with an array of light emitting diodes (LEDs), and more particularly to a white light emitting luminaire with a control system for adjusting the individual components to maintain a desired color balance (chromaticity).

LEDs are becoming increasingly important as illumination sources for a wide variety of applications. For general illumination and many special applications it is necessary to mix three colors of LED (i.e., red, green, and blue) to produce white light. One way to achieve this is to combine the RED, GREEN, and BLUE LED emissions with appropriate known optics and drive electronics.

U.S. Publication No. US 2001/0032985 A1 discloses an LED luminaire having an array of LEDs including a plurality of LEDs in each of the colors red, green and blue. The LEDs for each color are wired in parallel and provided with a separate power supply and drive electronics displaced from the LED array due to light sensitivity. The chromaticity of the assembly is measured using at least one light sensitive device, and can be controlled (i.e., calibrated) either manually or automatically.

An attractive feature of LED based illumination is the compactness of the illumination source and the small light spot size which can be on the order of tens of microns or less. This allows a high degree of flexibility to maneuver the light generated by means of standard optical components (i.e., lens, reflectors, etc.).

Current LED arrays employ drive electronics displaced from the LED arrays due to light sensitivity. This limits the performance and compactness of LED arrays, as well as increasing the cost of production. Given these limitations, it would be desirable to integrate the drive electronics of an LED array into a single integrated circuit.

SUMMARY OF THE INVENTION

The present invention includes integrated drive electronics fabricated in silicon-on-insulator technology resulting in improved white light generation.

In one aspect of the invention, an integrated circuit for controlling an array of LEDs includes at least one signal amplifier, signal processing means, driver means for driving the array of light emitting diodes, at least one switch, and control means for controlling the integrated circuit. In this aspect, the integrated circuit is formed using silicon-on-insulator technology and is selectively shielded from the array of LEDs.

In one embodiment, the integrated circuit is selectively shielded from the array of light emitting diodes by a coating layer.

In several other embodiments, the coating layer is a layer of metal. The metal may be opaque. The metal may also be aluminum.

In another embodiment, the coating layer contacts isolation regions around the integrated circuit.

In another embodiment, at least one metal crossing from the integrated circuit to a terminal of the array of LEDs minimizes light exposure to the active circuits.

In one embodiment, at least one metal crossing from the integrated circuit to a terminal of the array of LEDs minimizes light exposure to the active circuits by the metal coating layer being a meander line configuration surrounded by contact to the integrated circuit. In another embodiment the metal coating layer is coated with a second metal coating layer.

In one aspect of the invention, a luminaire includes an array of LEDs comprising at least one LED in each of a plurality of colors, at least one light sensitive element, and an integrated circuit for controlling the array of LEDs. The integrated circuit includes at least one signal amplifier, signal processing means, driver means for driving the array of light emitting diodes, at least one switch, and control means for controlling the integrated circuit. The integrated circuit also includes silicon-on-insulator and is selectively shielded from the array of light emitting diodes. In addition, at least one light sensitive element is exposed to the array of LEDs.

In one embodiment, at least one light sensing element further comprises at least one photo detector. In another embodiment, at least one photo detector is in substantial proximity to at least one LED in the array of LEDs.

In another aspect of the invention, a method of manufacturing an integrated circuit for controlling an array of LEDs includes the steps of incorporating drive electronics for the array of LEDs into a single silicon-on-insulator integrated circuit; selectively shielding the drive electronics; and mounting the array of LEDs on the integrated circuit.

The invention provides many advantages that are evident from the following description, drawings, and claims.

DETAILED DESCRIPTION OF THE PRIMARY EMBODIMENT

Figure 1:
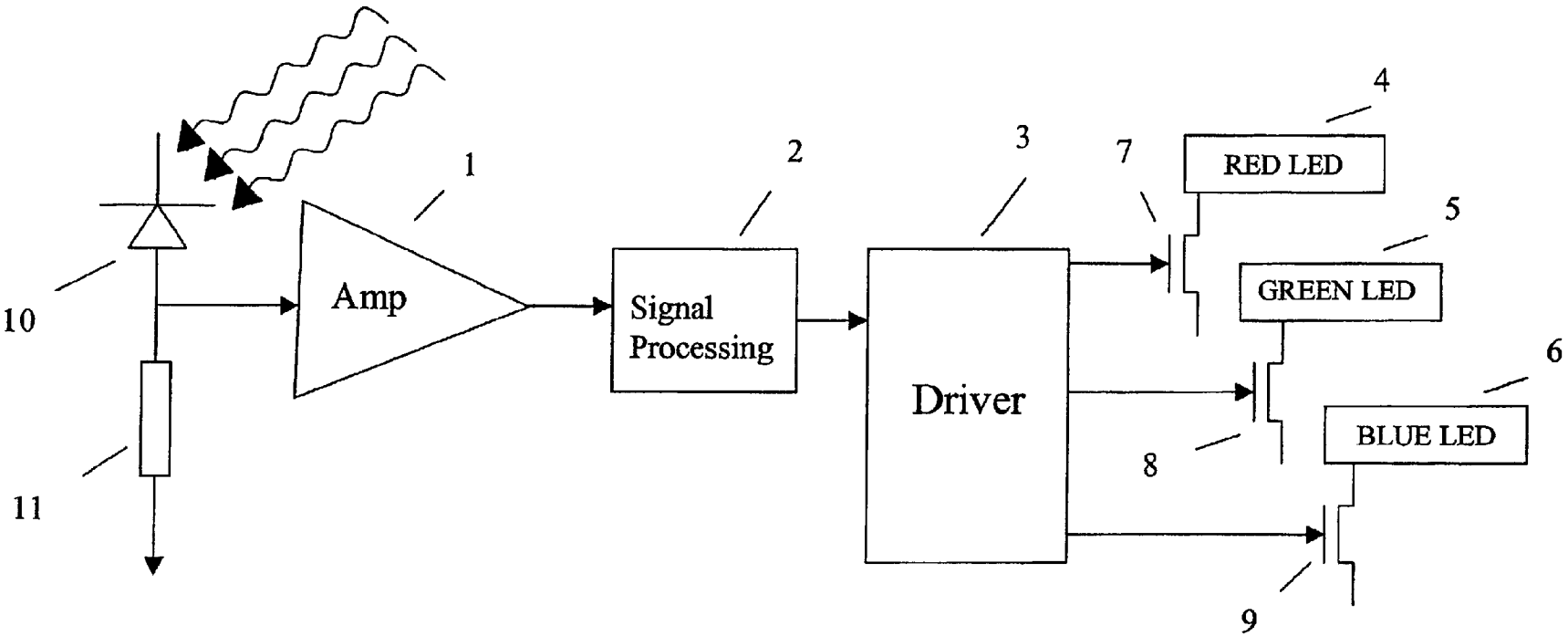
FIG. 1 is a circuit diagram for white light generation driving electronics with Red-Green-Blue LEDs.

FIG. 1 depicts a configuration for driving electronics, which drive a Red-Green-Blue (RGB) LED array capable of generating white light. LED array 4,5,6 generates white light through known techniques for color mixing. Photodiode 10 measures the white color balance produced by the RGB array 4,5,6 and sends a signal that is amplified by signal amplifier 1. Multiple photodiodes may also be used whereby each of the colors in the array is monitored separately. The signal is processed by signal processing means 2 and is then relayed to driver means 3. Signal amplifier 1 amplifies a signal received from control means 11. Driver means 3 adjusts the color balance by controlling high current and high voltage switches 7,8,9. In this configuration the LEDs of each color are wired in parallel and provided with a single power supply and drive electronics that are in close proximity to the LED array.

Figure 2:
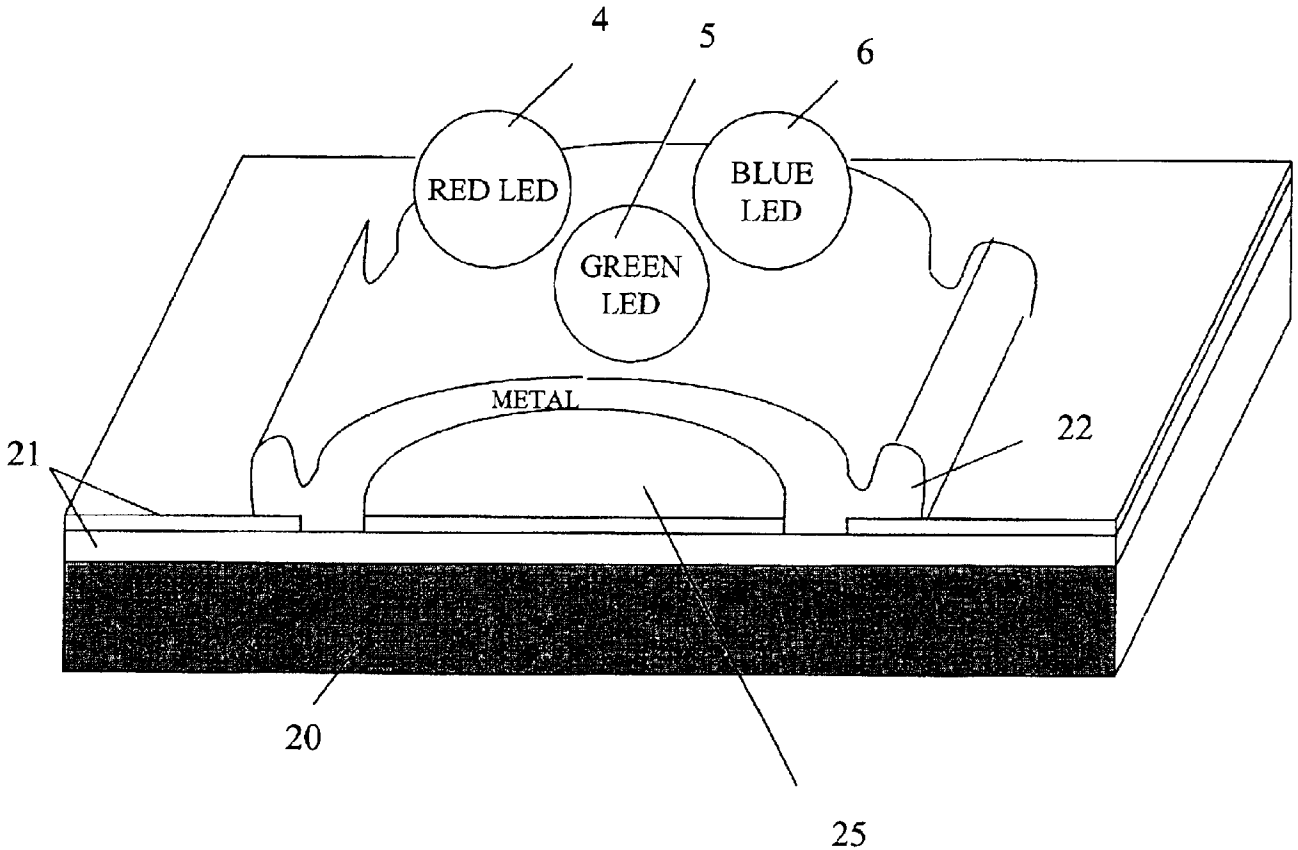
FIG. 2 depicts driving electronics in an IC with a metal layer covering the driving electronics.

The above configuration is implemented on a silicon-on-insulator (SOI) based integrated circuit. The LED array 4,5,6 can be mounted on top of the integrated circuit as shown in FIG. 2. Since the components of the driving electronics 25 form circuits that are sensitive to photon exposure, they must be selectively shielded. The driving electronics 25 are situated above an insulator substrate 20, which is coated with at least one layer of silicon 21. The driving electronics 25 are formed using known methods of forming SOI ICs. In order to selectively shield the driving electronics 25 from the LED array 4,5,6, a metal layer covering 22 covers them. The LED array 4,5,6 can be mounted directly on top of the driver electronics 25 utilizing the metal layer 22 as the ground electrode for example.

Figure 3:
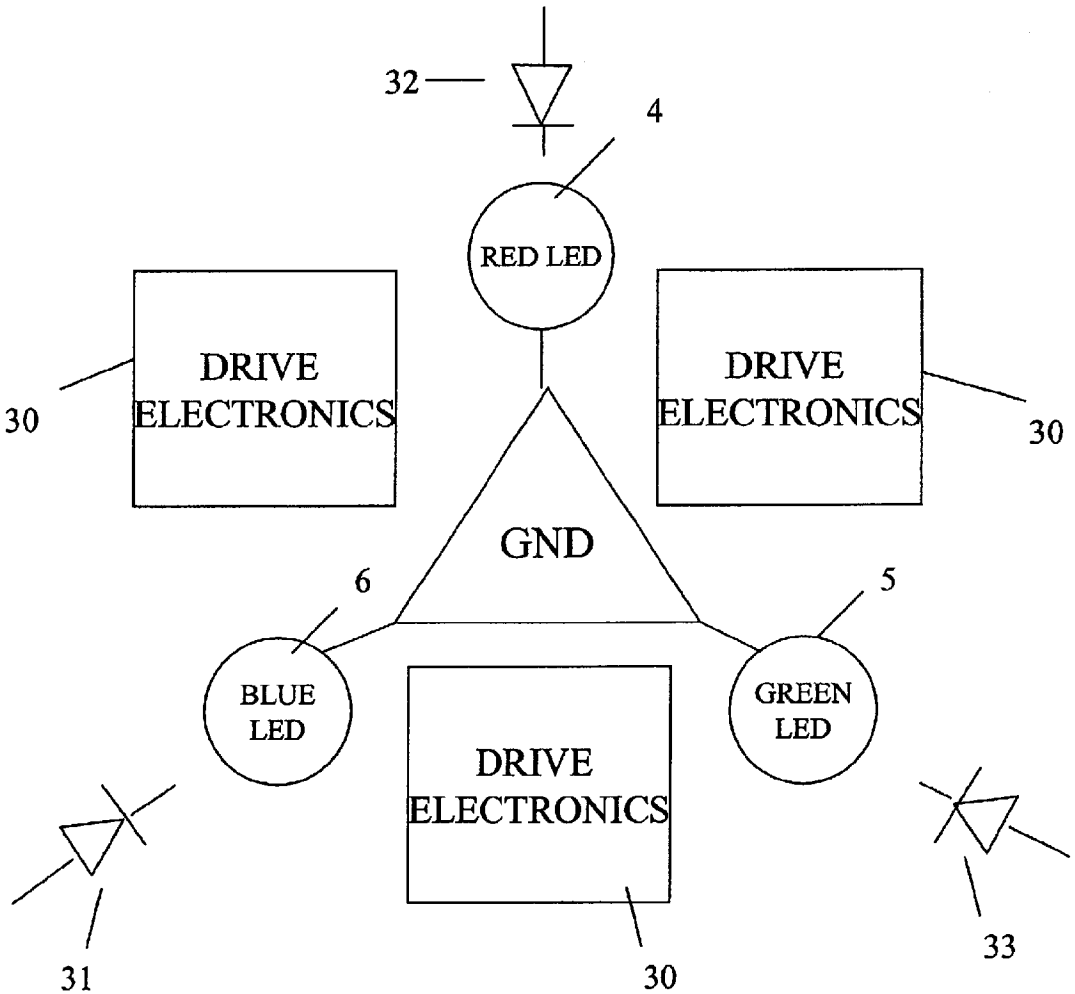
FIG. 3 depicts an embodiment of a LED array according to the present invention.

FIG. 3 is a top-view of a layout for an LED array 4,5,6 mounted above driver electronics 30 which are situated beneath a metal layer, as in FIG. 2, and between the LEDs 4,5,6. Photodiodes 31,32,33 are individually situated within close proximity to a LED in the LED array 4,5,6. Photodiodes 31,32,33 are used to measure the light output of each LED, after which driver electronics 30 adjust the color balance of the LED array 4,5,6. This configuration provides the advantage of protecting the driver electronics 30 from exposure to light emitted by the LED array 4,5,6, while allowing photodiodes 31,32,33 to be exposed to the LEDs in order to measure their output. This configuration allows for a more compact configuration (e.g., higher packing density) of the LED array and driver electronics than any other that presently exists in the prior art. This configuration also allows photodiodes 31,32,33 to be placed in close proximity to their respective LEDs in LED array 4,5,6 which allows for better output measurement and more accurate control for color balancing by, for example, minimizing the influence of the other two LEDs in the array on the photo detector (e.g., photo detector 31 is less affected by emissions from LEDs 4 and 5, and therefore provides a more accurate measurement of the output from LED 6). An additional photo detector (not shown) apart from the LED array 4,5,6 and drive circuitry 30, and photo detectors 31,32,33 can also be used to assist in calibrating true whiteness output of the LED array 4,5,6.

Figure 4:
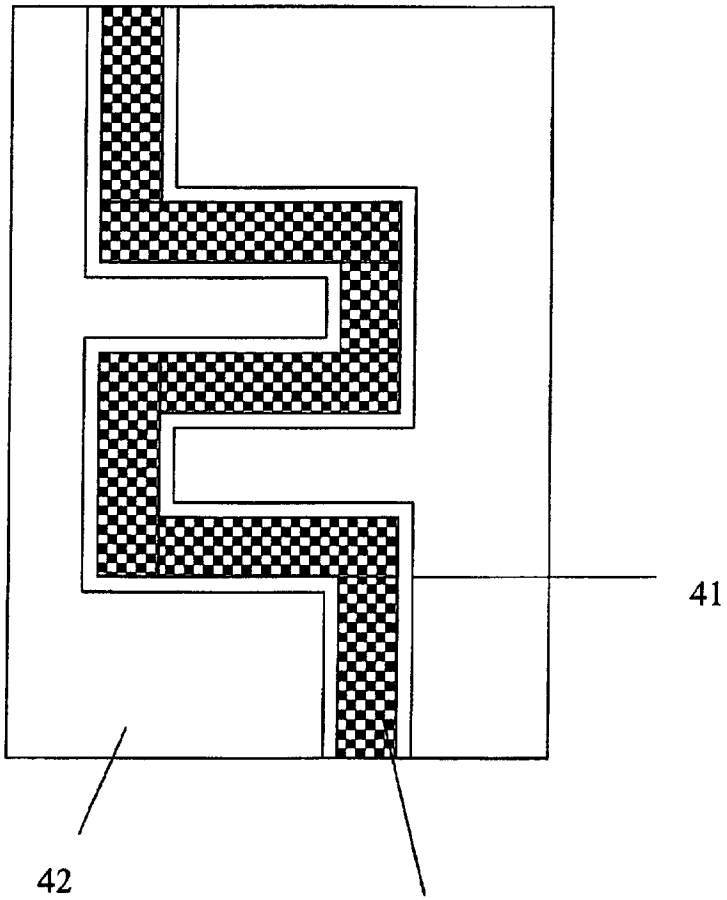
FIG. 4 depicts a meander line metal line surrounded by contact.

Metal crossings from the driving circuits to the LED terminals can be designed to minimize light creeping into the active driver circuits. FIG. 4 depicts a meander line metal line 40 surrounded by contact 42 A second metal layer above which LED array 4,5,6 covers the entire area of FIG. 4.

The preceding examples are exemplary and are not intended to limit the scope of the claims which follow.

What is claimed is:

1. An integrated circuit including active components for controlling an array of LEDs comprising:

at least one signal amplifier;

signal processing means coupled to an output of said amplifier;

driver means coupled to the output of said signal processing means for driving the array of light emitting diodes;

at least one switch coupled to the driver means; and control means coupled to one of a group consisting of the amplifier, the signal processing means, and the driver means for controlling the integrated circuit;

wherein the integrated circuit comprises silicon-on-insulator and is selectively shielded from photon exposure from the array of LEDs; and wherein at least one metal crossing from the integrated circuit to a terminal of the array of LEDs minimizes light exposure to the active components of the integrated circuit.

2. The integrated circuit of claim 1, wherein the integrated circuit is selectively shielded from the array of light emitting diodes by a coating layer.

3. The integrated circuit of claim 2, wherein the coating layer is a layer of metal.

4. The integrated circuit of claim 3, wherein the metal is opaque.

5. The integrated circuit of claim 3, wherein the metal is aluminum.

6. The Integrated circuit of claim 2, wherein the coating layer further contacts isolation regions around the integrated circuit.

7. The integrated circuit of claim 3, wherein a metal crossing from the integrated circuit to a terminal of the array of LEDs minimizes light exposure to the active circuits by the metal coating layer comprising a meander line configuration surrounded by a contact to the integrated circuit.

8. The integrated circuit of claim 7, wherein the metal coating layer is coated with a second metal coating layer.

9. A luminaire comprising:

an array of LEDs comprising at least one LED in each of a plurality of colors;

at least one light sensitive element;

an integrated circuit including active components for controlling the array of LEDs comprising:

at least one signal amplifier;

signal processing means coupled to an output of said amplifier;

driver means coupled to the output of said signal processing means for driving the array of light emitting diodes;

at least one switch coupled to the driver means; and control means coupled to one of a group consisting of the amplifier, the signal processing means, and the driver means for controlling the integrated circuit;

wherein the integrated circuit comprises silicon-on-insulator and is selectively shielded from photon exposure from the array of LEDs: and wherein at least one metal crossing from the integrated circuit to a terminal of the array of LEDs minimizes light exposure to the active components of the integrated circuit.

10. The luminaire of claim 9, wherein the at least one light sensitive element is exposed to the array of LEDs.

11. The luminaire of claim 10, wherein the at least one light sensitive element further comprises at least one photo detector.

12. The luminaire of claim 10, wherein the at least one light sensitive element is in substantial proximity to at least one LED in the array of LEDs.

13. The luminaire of claim 10, wherein the at least one light sensitive element is built into the silicon-on-insulator.

14. A method of manufacturing an Integrated circuit for controlling an array of LEDs comprising:

incorporating drive electronics for the array of LEDs into a single silicon-on-insulator integrated circuit;

selectively shielding the drive electronics from photon exposure;

providing at least one, metal crossing from the integrated circuit to a terminal of the array of LEDs wherein the at least one metal crossing comprises a meander line configuration surrounded by a contact to the integrated circuit: and mounting the array of LEDs on the integrated circuit.

15. The luminaire of claim 9, wherein the integrated circuit is selectively shielded from the array of light emitting diodes by a metal layer, and the metal layer comprises a ground electrode for the array of light emitting diodes.

* * * * *